United States Patent [19]

Akiyama et al.

[11] 4,329,806

[45] May 18, 1982

[54] FLUID ENGINE

[75] Inventors: Kenzo Akiyama; Ryoji Tomiyama, both of Tokyo, Japan

[73] Assignee: Tomy Kogyo Co., Inc., Tokyo, Japan

[21] Appl. No.: 95,785

[22] Filed: Nov. 19, 1979

[30] Foreign Application Priority Data

| | | | |
|---|---|---|---|
| Nov. 21, 1979 | [JP] | Japan | 53-143945 |
| Jun. 28, 1979 | [JP] | Japan | 54-82398 |
| Jun. 28, 1978 | [JP] | Japan | 54-82399 |

[51] Int. Cl.[3] ..... A63H 29/16; A63H 11/10; F01L 15/00

[52] U.S. Cl. ..... 46/44; 46/201; 91/188; 91/271

[58] Field of Search ..... 46/44, 206, 201, 202, 46/39; 60/370, 412, 407; 91/188, 5, 271, 457, 182, 273, 267, 265; 180/302

[56] References Cited

U.S. PATENT DOCUMENTS

| | | | |
|---|---|---|---|
| 819,653 | 5/1906 | Hawke | 46/206 |
| 1,154,793 | 9/1915 | Palmer | 60/370 |
| 1,219,938 | 3/1917 | Hamilton | 91/273 |
| 1,796,157 | 3/1931 | Moore | 46/253 |
| 2,115,556 | 4/1938 | Maniscalco | 91/188 |
| 2,294,304 | 8/1942 | Jones | 91/188 |
| 2,321,267 | 6/1943 | Van Der Werff | 91/457 |
| 2,404,512 | 7/1946 | May et al. | 91/457 |
| 2,478,002 | 8/1949 | Mott | 91/457 |
| 2,584,659 | 2/1952 | Audemar | 91/188 |
| 2,596,000 | 5/1952 | Weiss | 46/206 |
| 2,821,808 | 2/1958 | Rosato | 46/206 |
| 2,984,222 | 5/1961 | Smith | 91/188 |
| 3,040,665 | 6/1962 | Humphrey | 91/188 |
| 3,050,904 | 8/1962 | Morse | 46/213 |
| 3,066,441 | 12/1962 | Morse | 46/95 |
| 3,136,088 | 6/1964 | Crandall | 46/76 |
| 3,143,814 | 8/1964 | Brinkmeyer et al. | 91/188 |
| 3,513,657 | 5/1970 | Nelson et al. | 60/412 |
| 3,577,677 | 5/1971 | Bennett | 46/206 |
| 3,645,169 | 2/1972 | Clark | 91/273 |
| 3,691,670 | 9/1972 | Lemelson | 46/1 J |
| 3,774,504 | 11/1973 | Bonney | 91/457 |
| 3,789,540 | 2/1974 | Convertine et al. | 46/202 |
| 3,792,549 | 2/1974 | Lemelson | 46/1 J |
| 3,936,053 | 2/1976 | Goldfarb et al. | 273/108 |
| 3,950,889 | 4/1976 | Dabney | 46/44 |

*Primary Examiner*—Paul J. Hirsch
*Assistant Examiner*—Michael J. Foycik
*Attorney, Agent, or Firm*—Staas & Halsey

[57] ABSTRACT

A fluid engine for use in pneumatically operated toys such as wheeled vehicles or airplanes. The engine housing has a fluid input cavity which is in continuous fluid communication with a source of compressed air, a fluid delivery cavity which is in continuous communication with a piston cavity bounded by a movable piston mounted in a cylinder member and which is separated from the fluid input cavity by a wall having a valve opening therein, and an open-ended exhaust cavity which is separated from the fluid delivery cavity by a wall having an exhaust opening therein. A valve rod with a tapered end is movably housed in the exhaust cavity to open the valve opening and close the exhaust opening during the piston's power stroke, and to close the valve opening and open the exhaust opening during the piston's exhaust stroke. The valve rod can be operatively connected to the piston to act in synchronism with it either by use of a cam or by use of a network of connecting links.

17 Claims, 9 Drawing Figures

FLUID ENGINE

BACKGROUND AND SUMMARY OF THE INVENTION

The present invention relates to a fluid engine, and in particular to a fluid engine suitable for using compressed air to power a toy vehicle such as a toy wheeled vehicle or a toy airplane. The fluid engine is provided with a housing having three linearly disposed cavities in which a linearly movable valve rod is positioned. The fluid input cavity is in continuous fluid communication with a source of compressed air and is separated from the fluid delivery cavity by a wall having a valve opening therein. Similarly, the fluid delivery cavity is in continuous fluid communication with a piston cavity having a movable piston therein and is separated from an open-ended exhaust cavity by a wall having an exhaust opening therein. A piston member is operationally connected to the valve rod to open the valve opening and close the exhaust opening when the piston moves in one direction, thereby allowing fluid communication between the source of compressed air and the piston cavity, and to close the valve opening and open the exhaust opening when the piston member moves in the other direction, thereby allowing fluid communication between the piston cavity and the outer air. Two embodiments of the fluid engine, one using a rotating cam member to control the valve rod and the other employing a network of connected links to perform this function, are disclosed.

DETAILED DESCRIPTION

Figure 1:
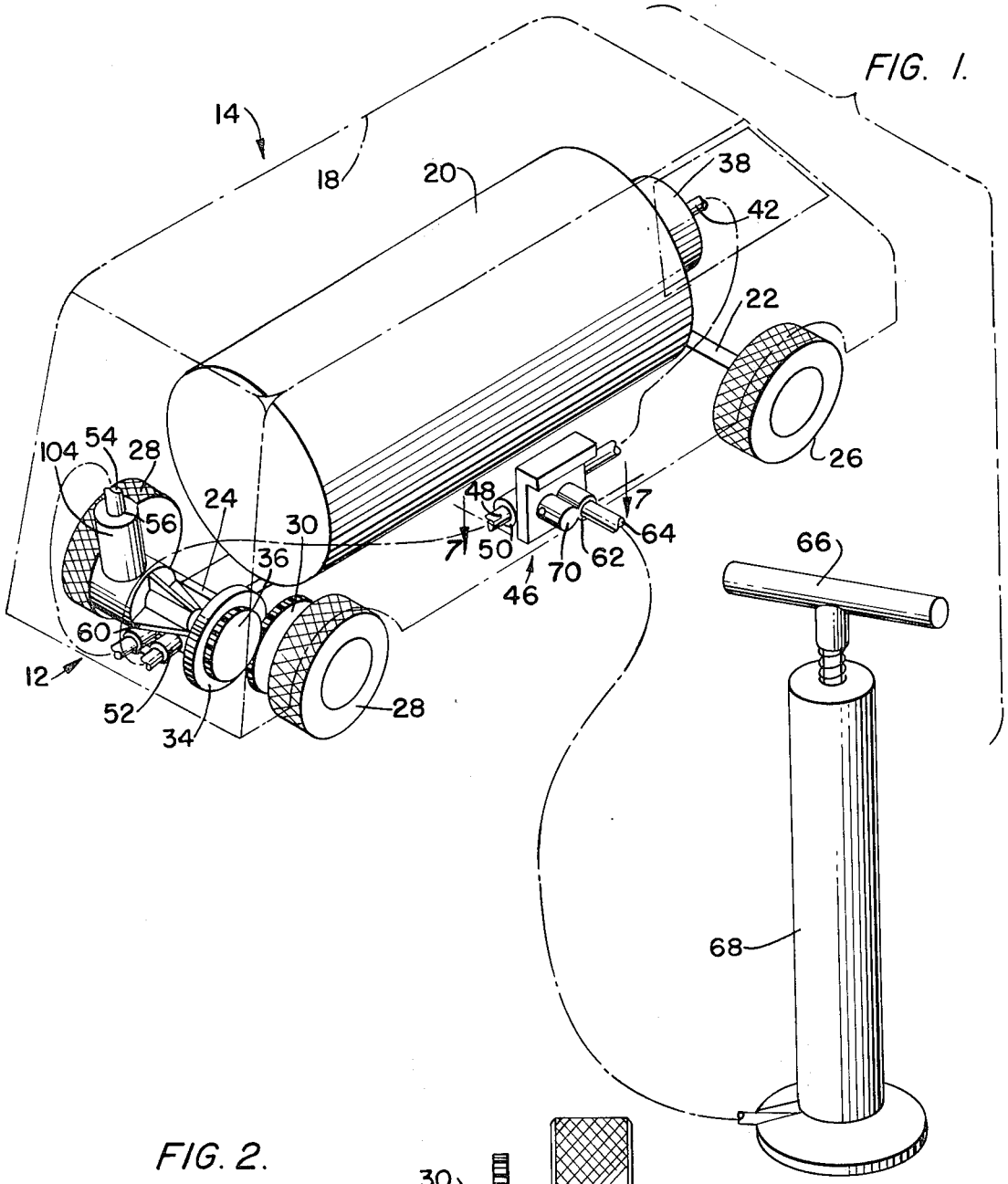
FIG. 1 is a perspective view of a fluid engine for powering a toy wheeled vehicle having a bottle for receiving compressed air from a conventional pump.

Fluid engine 12 of the present invention is illustrated in FIG. 1 installed within a toy wheeled vehicle 14, which includes a frame 16 (not illustrated) on which fits a vehicle cover 18. A fluid reservoir such as plastic bottle 20 is fixedly mounted to frame 16, as by rubber bands, and axles 22 and 24 are mounted for rotation on frame 16. Front wheels 26 are fixedly mounted on axle 22, while rear wheels 28 and gear 30 are fixedly mounted on axle 24. Engine 12, which is also mounted on frame 16, is provided with drive shaft 32 (see FIG. 3) on which are fixedly mounted flywheel 34 and gear 36. Gear 36 meshes with gear 30 to propel vehicle 14 when fluid engine 12 operates.

With continuing reference to FIG. 1, bottle 20 is provided with air-tight cap 38 having hole 40 (not illustrated) therein. One end of air-tight flexible tube 42 is sealingly engaged in hole 40, while the other end is sealingly engaged with port 44 (see FIG. 7) of valve member 46, which is affixed to frame 16. Similarly, one end of air-tight flexible tube 48 is sealingly engaged to port 50 of valve member 46, while the other end of tube 48 is sealingly engaged to fluid input port 52 of engine 12. Engine 12 includes air-tight flexible tube 54, one end of which is sealingly engaged in hole 56 in cylinder member 104 while the other end of tube 54 is sealingly engaged to fluid delivery port 60. It will apparent that, when bottle 20 is charged with compressed air, engine 12 will be fueled to propel vehicle 14 until the air is exhausted. To this end valve member 46 is provided with fueling port 62 into which air-tight flexible tube 64 fits when bottle 20 is being charged with air. Activating handle 66 of air pump 68, having conventional structure known in the art, a few times is sufficient for this purpose. Nevertheless, valve member 46 is provided with safety port 70 to insure that bottle 20 is not charged with too much air. After the fueling operation is completed tube 64 is withdrawn from port 62 and pump 68 is laid aside until it is needed again.

Figure 7:
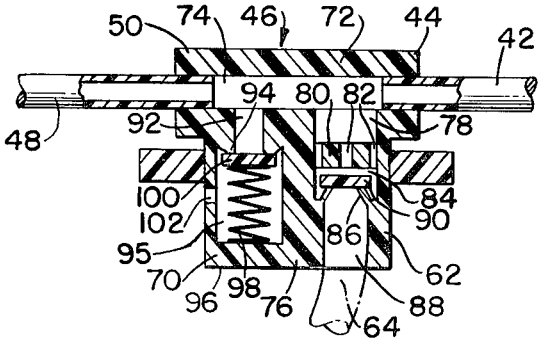
FIG. 7 is a view taken along the line 7—7 of FIG. 1, and illustrates the safety port and fueling port which may be installed in toy vehicles employing fluid engines of the present invention.

With reference now to FIG. 7, the construction of valve member 46 will be described. Valve member 46 is provided with plastic body 72 having cylindrical cavity 74 allowing fluid communication from tube 42 to tube 48. Tubes 42 and 48 are wedged into the respective ends of cavity 74, and the connections can be made air-tight by employing a suitable doping compound. Ports 62 and 70 are provided on projections 76 extending from member 46 and molded from the same plastic. One end of cylindrical cavity 78 in projection 76 communicates with cavity 74, while the other end is terminated by retaining wall 80 having channels 82 therein. Valve retaining cavity 84 is disposed within projection 76 between wall 80 and valve seat 86, which extends from the inner end of outer cylindrical cavity 88. It will be apparent that when pump 68 is activated after tube 64 is snugly inserted into cavity 88, incoming blasts of air will displace resilient valve element 90, which is provided within cavity 84, from valve seat 86 to allow fluid communication through cavity 88, cavity 84, channels 82, and cavity 78 into cavity 74. After a blast of air has been administered, the pressure differential between cavities 84 and 88 will force element 90 snugly against valve seat 86 to prevent air from escaping. After bottle 20 has been charged, tube 64 is withdrawn from cavity 88 and element 90 is retained against valve seat 86 due to the pressure differential, until bottle 20 is discharged.

With continuing reference to FIG. 7, cylindrical cavity 92 extends from cavity 74 to valve seat 94, and cylindrical cavity 95 extends from valve seat 94 to end portion 96. Spring 98 is positioned within cavity 96 to force resilient valve element 100 against valve seat 94 until a predetermined pressure threshold is exceeded. Should this occur, air pressure will force element 100 away from valve seat 94 to allow excess air from cavity 74 to flow through cavity 92 past valve seat 94 into cavity 96 and thence outward through vent hole 102.

Figure 2:
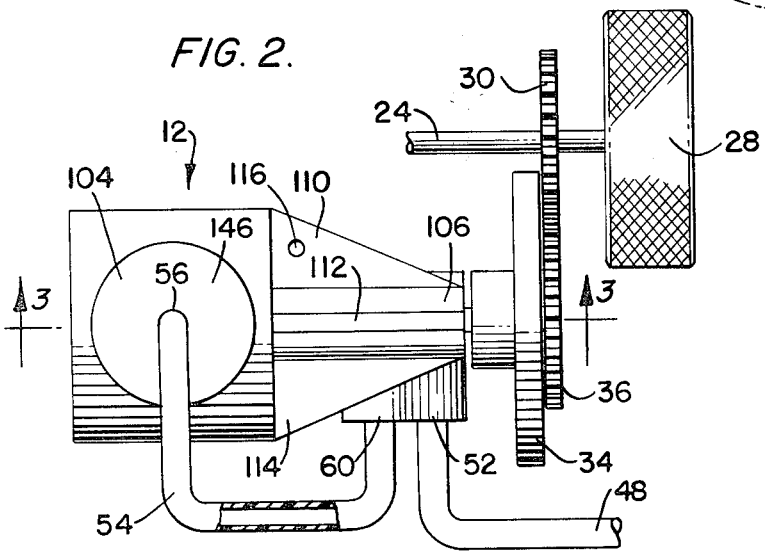
FIG. 2 is a top view of the fluid engine, flywheel, and one rear wheel illustrated in FIG. 1.
Figure 3:
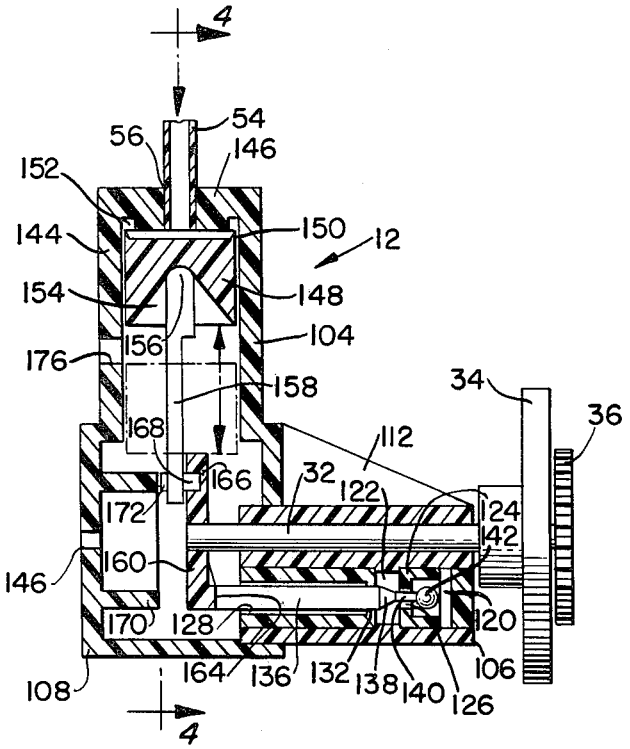
FIG. 3 is a sectional view taken along the line 3—3 of FIG. 2, and illustrates generally the reciprocating motion of the piston member.

With reference next to FIGS. 2 and 3, the housing of engine 12 is provided by hollow or cylinder member 104, valve member 106, and cover member 108. Members 104, 106, and 108 may be made of plastic and joined by any suitable means, such as by screws or by adhesive, in the configuration illustrated, with triangular bracing elements 110, 112 and 114 added to increase the rigidity of the structure. Hole 116 may be provided in element 110 to mounted engine 12 to frame 16, and mounting tab 118 (not illustrated) may be provided on cylinder member 104 for the same purpose.

Figure 6:
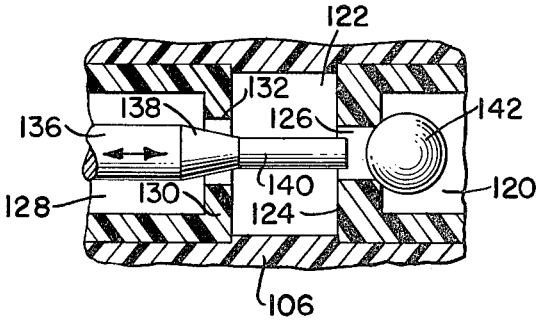
FIG. 6 is a view emphasizing part of FIG. 3, and illustrates the fluid input cavity, fluid delivery cavity and exhaust cavity, along with the motion of the valve rod.

With reference next to FIGS. 2, 3, and 6, fluid input cavity 120 is provided within valve member 106 to receive fluid flowing through input port 52 from tube 48. Fluid delivery cavity 122 is also positioned within member 106 and is separated from cavity 120 by wall 124 having valve opening 126 therein. Similarly, exhaust cavity 128 is provided within valve member 106 and is separated from fluid delivery cavity 122 by wall 130 having exhaust opening 132 therein. Fluid delivery port 60 allows fluid within cavity 122 to flow through tube 54 to hole 56 in end wall 146 of member 104.

With continuing reference to FIGS. 3 and 6, valve rod 136, which has a maximum diameter matching the diameter of exhaust opening 132, extends through exhaust cavity 128 and is free to slide therein. One end of rod 136 is terminated by conical portion 138 from which reduced diameter portion 140 extends. It will be apparent to those skilled in the art that when rod 136 is oriented as illustrated in FIG. 3, portion 140 extends through valve opening 126 to displace ball 142 from opening 126 to allow fluid communication between cavities 120 and 122. In the position illustrated in FIG. 3 rod 136 completely fills exhaust opening 132 to prevent fluid communication between cavity 122 and exhaust cavity 128. To increase the effectiveness of this seal a viscous lubricant can be applied to rod 136, and a small flexible flange 144 (not illustrated) of triangular cross-section may be provided around the periphery of opening 132. It will also be apparent to one skilled in the art that, when rod 136 is moved to the left with respect to FIG. 3, as is illustrated in FIG. 6, fluid within cavity 122 will be allowed to escape into exhaust cavity 128 and thence through opening 146 in member 108 by flowing through exhaust opening 132 past tapered portion 138. Simultaneously the pressure differential between cavities 120 and 122 will force ball 142 against valve opening 126 to isolate cavities 120 and 122. In short, there is fluid communication between input port 52 and delivery port 60 through valve opening 126 in wall 124 separating cavities 120 and 122 when valve rod 136 is in the position illustrated in FIG. 3. Moving rod 136 to the left with respect to FIG. 3, however, allows ball 142 to seal opening 126, thereby interrupting the fluid communication between ports 52 and 60, while simultaneously fluid within cavity 122 is allowed to communicate with exhaust cavity 128 through exhaust opening 132. It will be apparent to those skilled in the art that the present invention may be practiced without employing the elements of the precise form illustrated. For example, ball 142 could be replaced by a valve mechanism such as the one discussed above with respect to fluid delivery port 62, and an element having a relatively large first cross-sectional dimension with a projection having a relatively small cross-sectional dimension to protrude through opening 126 could be employed in lieu of a valve rod 136 in the form illustrated. Moreover, if the seal between cavities 120 and 122 is slightly leaky and if reduced performance is acceptable, an element corresponding to rod 136 can be used only to operate the valve between cavities 122 and 128, with the periodic pressure changes between cavities 120 and 122 automatically operating a ball or similar valve between cavities 122 and 120.

With continuing reference to FIG. 3, cylindrical member 104 is provided with cylindrical walls 144 terminated by end wall 146 having hole 56 therein. Piston member 148, which is preferably provided with flexible flange 150, is slidingly inserted within cylindrical walls 144. It will be apparent that the volume of piston cavity 152, which is bounded by piston member 148, end wall 146, and cylindrical walls 144, will vary between a minimum volume when piston member 148 is closest to end wall 146, as illustrated in FIG. 3, and a maximum value when member 148 is a maximum distance from end wall 146. Piston cavity 152 is in fluid communication with fluid delivery cavity 122 through tube 54 in the manner previously discussed. Piston member 148 is provided with conical surface 154 sloping towards cylindrical walls 144, while one end 156 of connecting rod 158 is blunted. It will be apparent that this construction avoids the use of a pin to movably join rod 158 to piston member 148 since, if rod 158 is separated from member 148 when engine 12 is started, it will slide into conical surface 154 without damaging either walls 144 or piston member 148. While engine 12 is running end 156 will remain pressed against surface 154.

Figure 4:
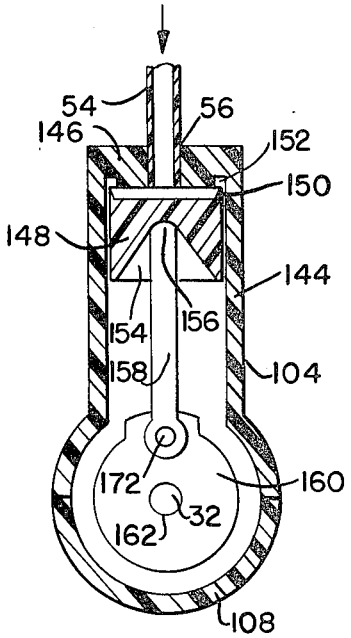
FIG. 4 is a sectional view taken along the line 4—4 of FIG. 3, and illustrates generally the introduction of air into the piston cavity.
Figure 5:
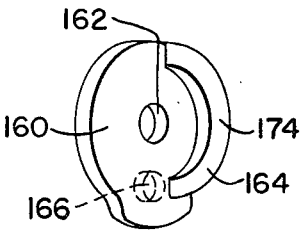
FIG. 5 is a perspective view of the disc element having a cam thereon for controlling the valve rod in one embodiment of the present invention.

With reference next to FIGS. 3, 4 and 5, disc element 160 has mounting hole 162 centrally located therein for attachment at right angles to drive shaft 32. Cam 164 is affixed to one side of member 160, while hole 166 is provided on the other side to loosely receive projection 168 extending from rod 158. Cylindrical abutment 170 extends from cover member 108 towards projection 172 extending from rod 158 to prevent projection 168 from falling out of hole 166. With rod 168 being movably mounted to disc element 160 by being sandwiched between abutment 170 and element 160 in the manner described, the use of a connective pin to movably join rod 158 to element 160 is avoided.

With continuing reference to FIG. 3, it will be apparent to those skilled in the art that connecting rod 158 and disc element 160 operationally connect piston member 148 to drive shaft 32 to convert reciprocating motion into rotary motion, while cam 164 simultaneously moves valve rod 136 to supply fluid to piston cavity 152, in the manner previously described, in synchronism with the reciprocation of piston member 148. In the configuration illustrated in FIG. 3, the high point 174 of cam 164 extends out of the paper. With the elements oriented as illustrated, exhaust opening 32 is closed and bottle 20 can be charged with air to the desired pressure. Thereafter, a slight rotation of flywheel 34 to bring piston member 148 off dead center to start engine 12 running. Should high point 174 be closer to valve rod 136 than is illustrated when the first puffs of air are delivered to bottle 20, however, piston member 148 will be forced downward, where it will remain due to the absence of sufficient momentum in flywheel 34, while bottle 20 is being charged. With this downward movement of piston member 148, cam 164 will be moved out of engagement with valve rod 136 and fluid pressure within cavity 120 will force ball 142 against valve opening 126. Slightly rotating flywheel 34 after bottle 20 is fully charged will then bring engine 12 to life. Should cam 164 not be oriented toward valve rod 136 when charging begins, this initial piston movement will not take place. Instead, the pressure difference between cavities 120 and 122 will immediately force ball 142 against valve opening 126, carrying valve rod 136 with it if portion 140 initially extended through valve opening 126. Again, slightly rotating flywheel 34 after bottle 20 is fully charged will bring engine 12 into operation.

It is convenient at this point to briefly summarize the operation of vehicle 14. Bottle 20 is charged with air by inserting tube 64 of conventional pump 68 into fueling port 62 and depressing handle 66 a few times. Excessive pressure is prevented by safety port 70. As the fueling operation begins vehicle 14 may give an initial lurch, due to the orientation of the elements within engine 12. At any rate, once bottle 20 is fully charged and tube 64 is removed, rotating wheels 28 slightly will bring engine 12 to life to propel vehicle 14 until the air within bottle 20 is exhausted. As engine 12 runs, the air within bottle 20 is delivered through tube 42, cavity 74, tube 48, and fluid input port 52 to fluid input cavity 120. As piston member 148 moves downward within cylindrical member 104, cam 164 engages valve rod 136 to close exhaust opening 132 and open valve opening 126, thereby allowing fluid communication from cavity 120 through valve opening 126, fluid cavity 122, fluid delivery port 60, and tube 54 to piston cavity 152. The fluid pressure in piston cavity 152 forces the piston member 148 downward, storing energy in flywheel 34 and rotating disc element 160. As piston member 148 approaches its bottom position cam 164 is disengaged from valve rod 136 and ball 142 discontinues the fluid communication between fluid input cavity 120 and fluid delivery port 122 while exhaust opening 132 is opened to allow fluid communication between fluid delivery cavity 122 and exhaust cavity 128. Piston cavity 152 is no longer in fluid communication with bottle 20, but it is in fluid communication with the outside air. If desired, however, a sound nozzle 176 may be drilled through cylindrical walls 144 to produce a "putt-putt" sound as the fluid within cavity 152 escapes. Continued rotation of flywheel 34 will return piston member 148 to the top of cylindrical member 104 and the reciprocating process will begin again.

Figure 9:
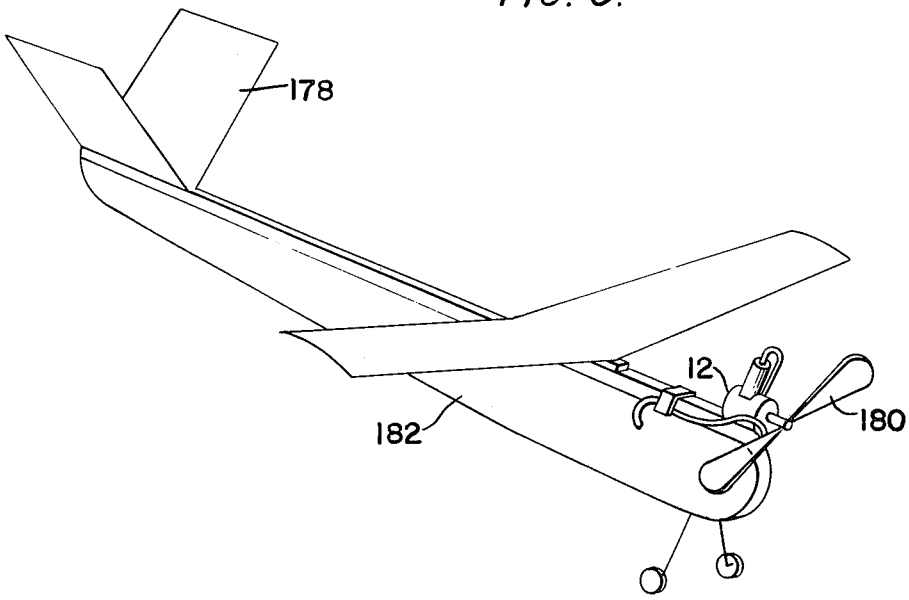
FIG. 9 is a perspective view illustrating a fluid engine used for propelling a toy airplane.

Although the foregoing discussion has illustrated the use of engine 12 for powering a toy wheeled vehicle 14, it will be apparent that there are other suitable applications. Since neither batteries nor liquid fuel are needed, the engine of the present invention is light enough to power toy vehicles such as airplane 178 illustrated in FIG. 9. Moreover, since propeller 180 rotates at a relatively fast rate, it is possible to avoid the additional weight of flywheel 34. Pressurized air is stored in bottle 182, which is configured to resemble the body of an airplane, and the engine, wheels, and wings are mounted on bottle 182.

Figure 8:
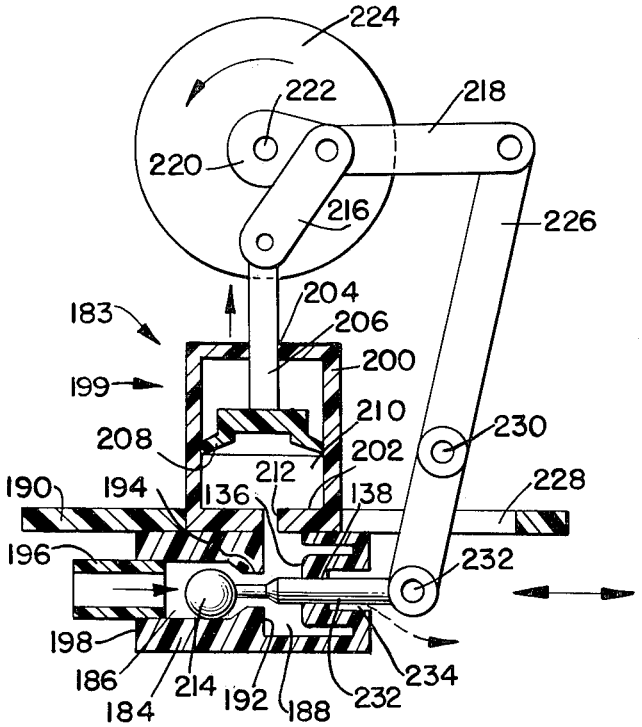
FIG. 8 is a cross-sectional view illustrating a second embodiment of a fluid engine of the present invention.

A second embodiment of the engine of the present invention will now be described with reference to FIG. 8, which illustrates fluid engine 183. Member 184 having fluid input cavity 186 and fluid delivery cavity 188 is fixedly mounted on chassis 190, with wall 192 having valve opening 194 between them. Air-tight flexible tube 196 is sealingly inserted into fluid input port 198 to allow fluid communication between a source of air and cavity 186. Cylindrical member 199 having cylindrical walls 200 and end wall 202 is affixed to chassis 190, with wall 200 having hole 204 through which extends connecting rod 206 on which piston member 208 is fixedly mounted. Piston cavity 210, which is bouned by piston member 208, is continuous fluid communication with cavity 188 through a hole forming fluid delivery port 212. It will be apparent that when air is delivered to fluid input port 198 when ball 214 is in the position illustrated, there is fluid communication between cavities 186 and 188 through valve opening 194, and fluid communication between cavity 188 and piston cavity 210 through fluid delivery port 212. The resulting pressure forces piston member 208 along with connecting rod 206 upward. Link 216 has one end movably joined to rod 206 and the other end movably joined to links 218 and 220. The other end of link 220 is fixedly joined to drive shaft 222 on which flywheel 224 is mounted, and the remaining end of link 218 is movably joined to link 226, which extends through slot 228 in chassis 190. Although not illustrated, it will be apparent that drive shaft 222 is suitably journalled for rotation on chassis 190 and that screw 230 movably joins link 226 to chassis 190 allowing link 226 to pivot around screw 230. It will also be apparent that the upward motion of piston member 208 is communicated via rod 206, link 216, and link 220 to drive shaft 222, thereby rotating flywheel 224. The motion is also imparted to link 226 via link 218, thereby reciprocating the end 232 of link 226 in the manner illustrated. As piston member 208 reaches it maximum distance from end wall 202, end 232 is moved to the right with respect to FIG. 8 allowing ball 214 to expel valve rod 232 and seal valve opening 194. Exhaust cavity 234 empties into the atmosphere and is separated from cavity 118 by wall 136 having exhaust opening 138 therein. The rightward movement of valve rod 138 allows fluid communication between cavities 188 and 234, thereby allowing the air within piston cavity 210 to escape as flywheel 224 continues rotating. When piston member 208 returns to its lowered position end 232 will force valve rod 232 to the left thereby dislodging ball 214 and simultaneously closing exhaust opening 328 to begin the process anew.

We claim:

1. A fluid engine comprising:

a housing having a fluid input cavity, a fluid delivery cavity adjacent said fluid input cavity and separated therefrom by a wall having a valve opening therein, and an open-ended exhaust cavity adjacent said fluid delivery cavity and being separated therefrom by a wall having an exhaust opening therein, said valve opening being substantially coaxial with said exhaust opening;

an elongated valve element movably disposed in said exhaust cavity, said valve element having a first portion with smaller cross-sectional dimensions than the cross-sectional dimensions of said exhaust opening and a second portion with cross-sectional dimensions substantially conforming to the cross-sectional dimensions of said exhaust opening, the first and second portions of said valve element being substantially immovable with respect to one another;

a drive shaft rotatably mounted on said housing;

an elongated hollow member mounted on said housing;

a piston member movably mounted within said hollow member to define a piston cavity, said piston member being movable between a first position wherein said piston cavity has minimum volume and a second position wherein said piston cavity has maximum volume;

fluid input port means for allowing continuous fluid communication between a fluid source and said fluid input cavity;

fluid delivery means for allowing continuous fluid communication between said fluid delivery cavity and said piston cavity;

valve means for controlling fluid flow between said fluid input cavity and said fluid delivery cavity through said valve opening; and means operationally connecting said piston member to said drive shaft and said elongated valve element for moving said elongated valve element toward said fluid input cavity to close said exhaust opening and open said valve means allowing fluid communication through said valve opening to said piston cavity when said piston member moves toward its second position, said means additionally moving said elongated valve element away from said fluid input cavity to open said exhaust opening and close said valve means allowing fluid communication from said piston cavity through said exhaust opening and discontinuing fluid communication through said valve opening when said piston member moves towards its first position.

2. The fluid engine of claim 1, wherein said valve means comprises a ball confined within said fluid input cavity.

3. The fluid engine of claim 2, wherein said valve opening is a circular hole in the wall separating said fluid input cavity from said fluid delivery cavity, said exhaust opening is a circular hole having larger diameter than said fluid input opening in the wall separating said fluid delivery cavity from said exhaust cavity, and said elongated valve element is a rod with said second portion thereof being a cylinder with a diameter substantially equal to the diameter of said exhaust opening.

4. The fluid engine of claim 3, wherein said first portion of said rod comprises a conical portion.

5. The fluid engine of claim 4, wherein said means operationally connecting said piston member to said drive shaft and said elongated valve element comprises a disk element fixedly mounted on said drive shaft, said disk element being operationally connected to said piston member and having a cam thereon positioned to engage said valve element.

6. The fluid engine of claim 5, wherein said piston member has a conical surface facing said disk element, and wherein said means operationally connecting said piston member to said drive shaft and said elongated valve element additionally comprises a connecting rod movably connected to said disk element, said connecting rod having a blunt end facing said conical surface of said piston member.

7. The fluid engine of claim 6, wherein said disk element has a hole therein on the opposite side from said cam, said connecting rod has a projection thereon near the end thereof opposite said blunt end, said housing has an abutment thereon facing said disk member and spaced apart therefrom, and said connecting rod is movably connected to said disk element by being sandwiched between said abutment and said disk element with said projection on said connecting rod being disposed within said hole in said disk element.

8. The fluid engine of claim 4, wherein said means operationally connecting said piston member to said drive shaft and said elongated valve element comprises a connecting rod extending from said piston member, a first link having a first end thereof fixedly mounted to said drive shaft and a second link having a first end thereof movably connected to said connecting rod, each of said first and second links having the second ends thereof movably connected at an intermediate connecting point, a third link having first and second ends, said third link being pivotably mounted to said housing at a point between said first and second ends thereof with said second end of said third link being positioned to engage said elongated valve element, and a fourth link having a first end movably connected to said first and second links at said intermediate connecting point and a second end movably connected to said first end of said fourth link.

9. The fluid engine of claim 1, 3, 7, or 8, wherein said piston member has a flexible flange thereon.

10. A toy vehicle, comprising: a fluid engine, wherein said fluid engine comprises a housing having a fluid input cavity, a fluid delivery cavity adjacent said fluid input cavity and separated therefrom by a wall having a valve opening therein, and an open-ended exhaust cavity adjacent said fluid delivery cavity and being separated therefrom by a wall having an exhaust opening therein, said valve opening being substantially coaxial with said exhaust opening;

an elongated valve element movably disposed in said exhaust cavity, said valve element having a first portion with smaller cross-sectional dimensions than the cross-sectional dimensions of said exhaust opening and a second portion with cross-sectional dimensions substantially conforming to the cross-sectional dimensions of said exhaust opening, the first and second portions of said valve element being substantially immovable with respect to one another;

a drive shaft rotatably mounted on said housing;

an elongated hollow member mounted on said housing;

a piston member movably mounted within said hollow member to define a piston cavity, said piston member being movable between a first position wherein said piston cavity has minimum volume and a second position wherein said piston cavity has maximum volume;

fluid input port means for allowing continuous fluid communication between a fluid source and said fluid input cavity;

fluid delivery means for allowing continuous fluid communication between said fluid delivery cavity and said piston cavity;

valve means for controlling fluid flow between said fluid input cavity and said fluid delivery cavity through said valve opening; and means operationally connecting said piston member to said drive shaft and said elongated valve element for moving said elongated valve element toward said fluid input cavity to close said exhaust opening and open said valve means allowing fluid communication through said valve opening to said piston cavity when said piston member moves toward its second position, said means additionally moving said elongated valve element away from said fluid input cavity to open said exhaust opening and close said valve means allowing fluid communication from said piston cavity through said exhaust opening and discontinuing fluid communication through said valve opening when said piston member moves toward its first position;

an air-tight container;

means for receiving compressed air into said air-tight container; and means for delivering air from said air-tight container to said fluid input cavity of said fluid engine.

11. The toy vehicle of claim 10, wherein said valve means is a ball confined within said fluid input cavity, said valve opening is a circular hole in the wall separating said fluid input cavity from said fluid delivery cavity, said exhaust opening is a circular hole having larger diameter than said fluid input opening in the wall separating said fluid delivery cavity from said exhaust cavity, and said elongated valve element is a rod with said second portion thereof being a cylinder with a diameter substantially equal to the diameter of said exhaust opening.

12. The toy vehicle of claim 11, wherein said first portion of said rod comprises a conical portion, said means operationally connecting said piston member to said drive shaft and said elongated valve element comprises a disk element fixedly mounted on said drive shaft, said disk element being operationally connected to said piston member and having a cam thereon positioned to engage said valve element, said piston member has a conical surface facing said disk element, said means operationally connecting said piston member to said drive shaft and said elongated valve element additionally comprises a connecting rod movably connected to said disk element, said connecting rod having a blunt end facing said conical surface of said piston member, said disk element has a hole therein on the opposite side from said cam, said connecting rod has a projection thereon near the end thereof opposite said blunt end, said housing has an abutment thereon facing said disk member and spaced apart therefrom, and said connecting rod is movably connected to said disk element by being sandwiched between said abutment and said disk element with said projection on said connecting rod being disposed within said hole in said disk element.

13. The toy vehicle of claim 13, wherein said means operationally connecting said piston member to said drive shaft and said elongated valve element comprises a connecting rod extending from said piston member, a first link having a first end thereof fixedly mounted to said drive shaft and a second link having a first end thereof movably connected to said connecting rod, each of said first and second links having the second ends thereof movably connected at an intermediate connecting point, a third link having first and second ends, said third link being pivotably mounted to said housing at a point between said first and second ends thereof with said second end of said third link being positioned to engage said elongated valve element, and a fourth link having a first end movably connected to said first and second links at said intermediate connecting point and a second end movably connected to said first end of said fourth link.

14. The toy vehicle of claim 10, 11, 12, or 13, wherein said toy vehicle is a wheeled vehicle having a rotatably mounted axle operationally connected to said drive shaft of said fluid engine.

15. The toy vehicle of claim 10, 11, 12, or 13, wherein said toy vehicle is an airplane having a propeller operationally connected to said drive shaft of said fluid engine.

16. The toy vehicle of claim 10, 11, 12, or 13, wherein said means for receiving compressed air comprises a fueling port attached to said toy vehicle, said fueling port including a body having a first cavity in fluid communication with said air-tight container, a second cavity emptying into said first cavity, a valve retaining cavity separated from said second cavity by a retaining wall having at least one channel therein, an outer cavity having one end thereof opening into the outer air and the other end thereof terminated by a valve seat projecting from said body into said valve retaining cavity, and a valve element movably positioned in said valve retaining cavity between said retaining wall and said valve seat.

17. The toy vehicle of claim 1, wherein said means for receiving compressed air additionally comprises a safety port provided by said body, said body including a third cavity emptying into the outer air, a fourth cavity having a first end emptying into said first cavity and said second end terminated by a valve seat projecting from said body into said third cavity, a valve element in said third cavity, and spring means for biasing said valve element against said valve seat.

* * * * *